United States Patent [19]

Nozaki et al.

[11] Patent Number: 4,504,139

[45] Date of Patent: Mar. 12, 1985

[54] COPYING APPARATUS

[75] Inventors: Hiromi Nozaki; Eiichi Yoshida, both of Hachioji, Japan

[73] Assignee: Konishiroku Photo Industry Co., Ltd., Tokyo, Japan

[21] Appl. No.: 432,838

[22] Filed: Oct. 5, 1982

[30] Foreign Application Priority Data

Oct. 18, 1981 [JP] Japan ..... 56-166896

[51] Int. Cl.[3] ..... G03G 15/00

[52] U.S. Cl. ..... 355/14 R; 355/69

[58] Field of Search ..... 355/69, 14 C, 14 R, 355/68, 71

[56] References Cited

U.S. PATENT DOCUMENTS 4,090,108 5/1978 Johnson et al. ..... 355/69 X

FOREIGN PATENT DOCUMENTS 2079004 1/1983 United Kingdom ..... 355/14 C

*Primary Examiner*—L. T. Hix
*Assistant Examiner*—Della Rutledge
*Attorney, Agent, or Firm*—Jordan B. Bierman

[57] ABSTRACT

A power device for a copying apparatus isolates the control circuit from electrical noise from an AC power line for the copying apparatus. A storage battery is used as a direct current power source for the control circuit, such that the control circuit is driven by power from the storage battery during copying operation, and the storage battery is charged during the period of stand-by for copying.

2 Claims, 1 Drawing Figure

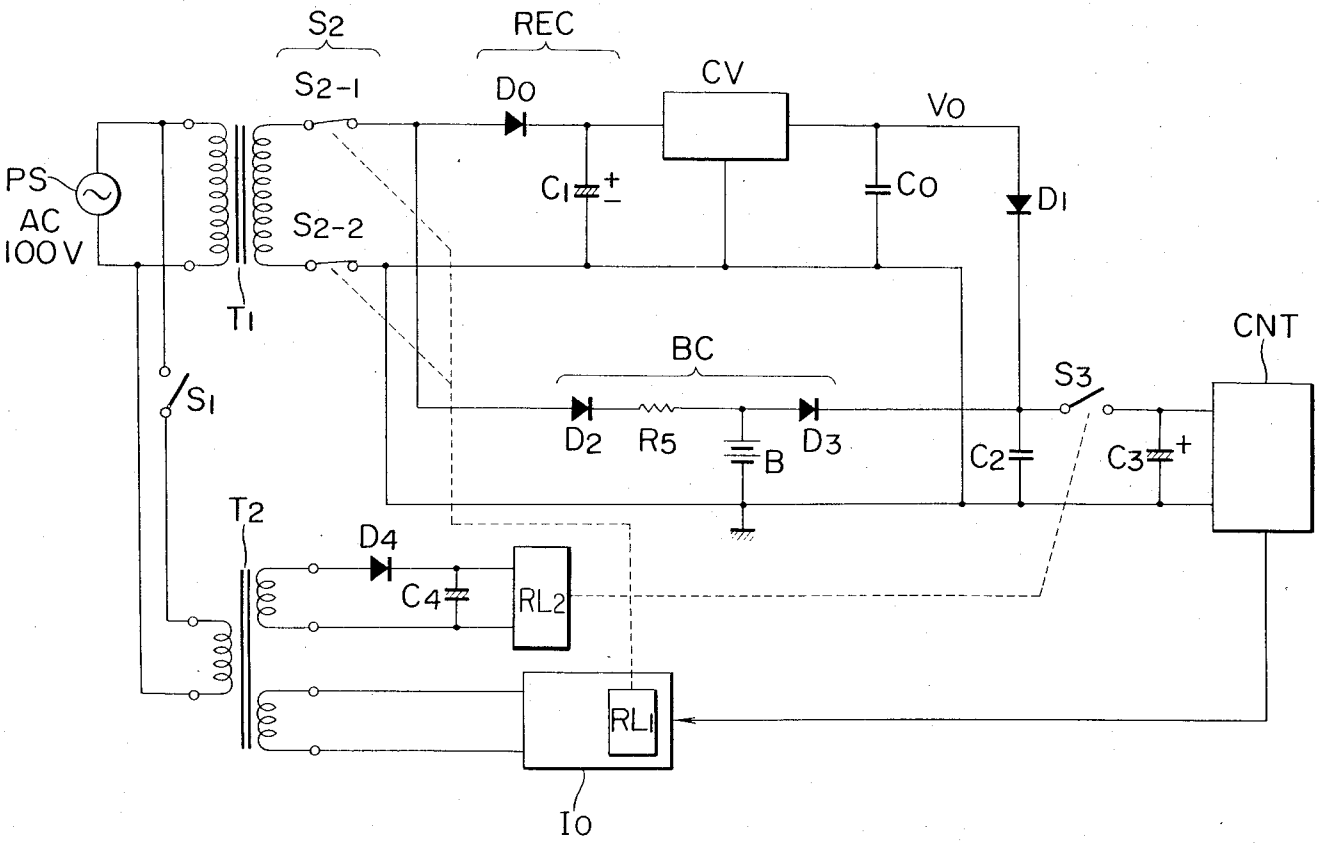
CNT
C3
S3
D1
C2
VO
CO
D3
B
CV
BC
R5
RL1
IO
REC
C1
D2
RL2
DO
C4
D4
S2
S2-1
S2-2
T1
T2
S1
PS
AC
100V

COPYING APPARATUS

BACKGROUND OF THE INVENTION

The present invention relates to a copying apparatus and more particularly to a power source device thereof.

In recent copying apparatus, IC logical circuits or microcomputers have often been employed for the control of various sections of the copying apparatus. The copying apparatus has some loads which are operated by a power source of large capacity and high voltage, and thereby there has been experienced a problem that erroneous operation of the control circuit is caused by such loads which generate electrical noise. Erroneous operation can be caused when electrical noise on the power line enters the control circuit. The control circuit uses a direct current power source which is obtained by smoothing the alternating current power source. Noise gets on the line of a load input/output element provided in the copying apparatus that shares a power source with the control circuit, and thus affects the control circuit. In order to solve this problem, the use of an LC filter and other wiring methods have been tried but their effects are not satisfactory and both of them have failed to be a definite solution thereof.

SUMMARY OF THE INVENTION

The present invention has been devised taking the aforesaid points into consideration. In a copying apparatus of the present invention, electric power is supplied to the control circuit during the period of a copying operation from a storage battery separated from the alternating current power source line whereby an improvement in noise resistivity is obtained.

The present invention will be explained in detail referring to the drawing.

BRIEF DESCRIPTION OF THE DRAWING

The drawing is a schematic drawing of a circuit of a power source according to the present invention.

DETAILED DESCRIPTION OF THE PREFERRED EMBODIMENT

The drawing represents an electric connection diagram showing the key portion of an example of a power source device according to the present invention. In the drawing, $T_1$ and $T_2$ represent power source transformers. To the primary winding of transformer $T_1$, alternate current of 100 V is supplied from a commercial power source PS and to the primary winding of transformer $T_2$, alternate current of 100 V is supplied through main switch $S_1$ from commercial power source PS. A low voltage of AC generated by the secondary winding of transformer $T_1$ is introduced simultaneously into both of rectifying circuit REC and charging circuit BC through primary switch $S_2$. The switch $S_2$ is an ON-OFF switch actuated by relay $RL_1$ which is arranged inside input.output unit IO, as will be explained later. Switch $S_2$ is a constantly closing type duplex switch $S_1$-1, $S_2$-2 which is usually in the state of ON but is turned in the state of OFF only at the moment when relay $RL_1$ operates. Rectifying circuit REC obtains a DC voltage through a diode $D_0$ rectifying the AC voltage and a capacitor $C_1$ smoothing the same. CV is a constant-voltage circuit which takes the output voltage of the rectifying circuit REC and then transmits a constant voltage $V_0$. For such a constant-voltage circuit, any of the popular types of integrated circuits for constant-voltage power sources may be used. Capacitor $C_0$ is connected to the output terminal of constant-voltage circuit CV. The output voltage $V_0$ of the abovementioned constant-voltage circuit CV is applied to the output terminal of charging circuit BC through diode $D_1$. The charging circuit BC rectifies the AC voltage and charges a storage battery B with the DC voltage obtained by rectifying the AC voltage. It is so constituted as to use diode $D_2$ for rectifying an AC voltage and to apply the DC voltage to storage battery B through resistor $R_5$ and, at the same time, to transmit the voltage of storage battery B to the output terminal of charging circuit BC through diode $D_3$. To the output terminal of charging circuit BC, capacitor $C_2$ is connected and the output voltage of storage battery B and the output voltage $V_0$ of constant-voltage circuit CV are applied, respectively, through diodes $D_3$ and $D_1$. The voltage at each end of capacitor $C_2$ are supplied to control circuit CNT as the power voltage, through secondary switch $S_3$. The secondary switch $S_3$ is driven by relay $RL_2$ which will be explained hereinafter. To the power inputting terminal of control circuit CNT, capacitors $C_3$ is connected in parallel in order to smooth the input voltage further. Control circuit CNT comprises an IC logical circuit, a microcomputer or the like. Control circuit CNT not only generates control signals necessary for operating various mechanisms of a copying apparatus but also performs operations such as the computation of copying numbers. Input.output signals generated by the control circuit CNT are insulated from every unit operated by the AC power source inside the copying apparatus. For insulating the signals, a photo-coupler and the like, for example, may be used. Relay $RL_2$ drives the secondary switch $S_3$ after main-switch $S_1$ is turned on so as to constantly supply electric power to the control circuit CNT, and the relay is energized by a DC voltage which is obtained by rectifying and smoothing an AC voltage generated on one of the secondary windings of transformer $T_2$ by means of diode $D_4$ and capacitor $C_4$. Besides the above, there may be various other ways to turn the secondary switch $S_3$ on or off. For example, there may also be used an AC relay operated by an AC voltage, in place of the DC relay $RL_2$, and in this case the diode $D_4$ and the capacitor 4 will not be necessarily used. When relay $RL_2$ is energized once, switch $S_3$ is then turned on. Input.output unit IO represents as a whole the unit of relay $RL_1$, an input element of an operating mechanism, a load driven by an intensive current and high voltage and the like. Relay $RL_1$ receives voltage from the other secondary winding of transformer $T_2$ and then operates in response to a control signal generated by control circuit CNT, and thus drives primary switch $S_2$.

The following is the description of the operations of an apparatus having such a constitution as mentioned above:

(1) In the case that main-switch $S_1$ is turned off:

Transformer $T_1$ is supplied with AC power even while main-switch $S_1$ is turned off. On the other hand, the AC power supply is cut-off to transformer $T_2$, so that relay $RL_1$ is not operated, switch $S_2$ is still turned on, relay $RL_2$ also is not operated, and switch $S_3$ still remains turned off. The voltage of the secondary winding of transformer $T_1$ is introduced into both of charging circuit BC and rectifying circuit REC through switch $S_2$. The charging circuit BC rectifies the introduced AC voltage to obtain a DC voltage and thus charges storage battery B. On the other hand, the rectifying circuit REC rectifies and smooths the introduced AC voltage to feed the rectified and smoothed voltage to constant-voltage circuit CV. The constant voltage circuit CV generates a constant voltage $V_0$. However, the constant voltage is not fed to the control circuit CNT because switch $S_3$ is turned off, and also is not fed to storage battery B because the constant-voltage circuit CV is cut-off by diode $D_3$.

(2) In the case that main-switch $S_1$ is turned on: (i.e., in the case of standing-by for copying operation)

Transformer $T_2$ is supplied with an AC power and relay $RL_2$ is operated, so that switch $S_3$ is thus turned on. At this moment, control circuit CNT is supplied with an output voltage $V_0$ generated by the constant-voltage circuit CV through diode $D_1$ and switch $S_3$, while charging circuit BC continues to charge battery B. The period of this condition is the so-called stand-by period for copying operation.

(3) In the case of copying operation:

When a copy-start command is given from an operation mechanism which is not shown in the drawing to control circuit CNT, the control circuit CNT gives a control signal to input.output unit IO and energizes relay $RL_1$. Thereby, primary switch $S_2$ is turned off, and consequently the output voltage generated by constant-voltage circuit CV is neutralized and thus only the voltage from storage battery B is supplied to the control circuit CNT through diode $D_3$ and switch $S_3$. Accordingly, the control circuit CNT is thus driven by an independent DC power which is absolutely separated from the AC power line, so that noise will not be introduced from input.output unit IO and the like through the AC line.

Various other types of circuits may be devised in addition to the abovementioned example. For example, it may be possible to use other types of relays and contact points thereof.

As stated above, in accordance with the invention, it is possible to obtain a copying apparatus having excellent noise-resistivity, because the battery is separated from the AC line, and only the insulated voltage thereof is given to the control circuit to serve as the power voltage.

What is claimed is:

1. A power device for a copying apparatus of the type having a control circuit for controlling a copying operation and an AC power source for powering the copying operation, comprising a DC power circuit including a storage battery for providing a DC power source to the control circuit, and a first switch for connecting the DC power circuit to the AC power source at times other than during a copying operation and disconnecting the DC power circuit and storage battery from said AC power source upon initiation of a copying operation so that the control circuit is driven only by power fed from the storage battery.

2. The power device as set forth in claim 1 wherein said first switch is normally closed and is opened by said control circuit in response to initiation of the copying operation, and wherein said DC power circuit further includes a rectifying circuit which rectifies and smoothes AC voltage fed through said first switch, a constant voltage device that regularizes the voltage fed from the rectifying circuit, and provides an output DC voltage, a charging circuit for charging the storage battery from the AC power source when said first switch is in the normally-closed position, and a second switch, which is closed when the copying apparatus is placed in an On state for a copying operation, for providing the output voltage of the constant voltage device and/or the output voltage of the storage battery, each fed through a respective diode, to said control circuit as the DC power source voltage, said second switch being switched to the open state when the copying apparatus is turned to an Off state so as to disconnect the control circuit from the DC power source.

* * * * *